United States Patent [19]

Herwick et al.

[11] 4,300,371

[45] Nov. 17, 1981

[54] EQUIPMENT SECURITY DEVICE

[76] Inventors: Dale L. Herwick, 3637 Berryman Ave., Los Angeles, Calif. 90066; Michael W. Adams, 19803 Hemmingway St., Canoga Park, Calif. 91306

[21] Appl. No.: 131,289

[22] Filed: Mar. 18, 1980

[51] Int. Cl.[3] ..... E05B 73/00

[52] U.S. Cl. ..... 70/58; 248/553

[58] Field of Search ..... 70/18, 57, 58, DIG. 57; 248/551, 552, 553

[56] References Cited

U.S. PATENT DOCUMENTS

| | | | |
|---|---|---|---|
| 3,859,826 | 1/1975 | Singer | 70/58 |
| 4,007,613 | 2/1977 | Gassaway | 70/58 |
| 4,055,973 | 11/1977 | Best | 70/58 |
| 4,118,902 | 10/1978 | Saxton | 70/58 |

FOREIGN PATENT DOCUMENTS

| | | | |
|---|---|---|---|
| 7401814 | 8/1975 | Netherlands | 70/58 |

*Primary Examiner*—Robert L. Wolfe

*Attorney, Agent, or Firm*—William H. Maxwell

[57] ABSTRACT

A security attachment that discourages thievery of office and work machines and the like from support furniture too difficult to asport, and comprised of a furniture receptacle and cover plate combination which includes the reception of a lock barrel applied through the bottom cover of the machine by means of a key and to which a cable lanyard is attached and passed through the frame of the machine for its limited movement with respect to the furniture.

18 Claims, 4 Drawing Figures

EQUIPMENT SECURITY DEVICE

BACKGROUND

The asportation of table-top machines is quite common, where such machines are moveable, reference being made to presses, cutters, labelers, sewing machines, typewriters, calculators, computors and various processors etc. However, the combination of a bench or table and such a machine would be too cumbersome to be subject to theft, and therefore would be overlooked by the burglar or thief. That is, the inconvenience of moving large furnishings can be expected to discourage theft of machines made a part thereof. Accordingly, this invention provides for locked attachment of machines and the like to larger furnishings such as desks and benches. With the present invention the equipment item is held secure to the furniture under lock and key.

There are many variations in machine design; but invariably there is a frame which consitutes the main portion of such a machine and without which it would be worthless. For example, business machines are most often comprised of a frame removeable from a bottom cover or a base which has table-top support. The base serves both mechanically and ornamentally, having a perimeter that matches with the cover and all of which establishes a housing for enclosing the mechanism with exposure of controls and other utilitarian features. Without the bottom cover or the base the machine would become worthless and accordingly it is this part of the machine in particular that is attached to the supporting furniture by lock and key when using the security device as it is disclosed herein. However, this does not preclude the direct application of this security device to any machine frame of the type under consideration.

Office machines and the like may or may not be fastened to the supporting furniture, and most furniture supports therefor are provided with stations, or positions, designed especially for the machine involved. Therefore, it is not uncommon to drill and to apply fasteners through the tops of furniture, such as for example a desk top. Accordingly, it is an object herein to employ an opening through the furniture support and protected under lock and key so that the installation features thereof are inaccessible. That is, the mounting features of this securement device are covered and rendered inaccessible when the lock is applied to secure the machine to be protected. Therefore, it is only by means of a key that the lock can be released to expose said mounting fasteners for disassembly when and if required.

Moveability of office machines or any such work machine is a usual requirement, for cleaning thereabout, for service and/or repair, and for adjustment and convenience to personnel operating the same. It is therefore, an object of this invention to provide limited mobility of such machines, and to this end a flexible cable is employed and of material and construction that is virtually impossible to cut under the conditions imposed by the closeness of this lock and key securement.

It is another object of this invention to provide few and simple and easily formed parts that are rugged and dependable and of configurations that defy the application of tools that a tempted burglar or thief might employ. In practice, heavy gage stainless steel is fabricated as hereinafter disclosed to secure the barrel of a security-type locking unit to which the aforesaid cable is attached without modification to the frame or base of the machine secured thereby.

SUMMARY OF THE INVENTION

This invention relates to the security of office and/or work machines and the like that are supported upon heavier more immoveable furniture such as desks and/or work benches, and which would be subject to asportation by burglars and thieves. It is a general object of this invention to prevent and substantially discourage thievery, and to this end lock and key hardware is provided in the form of separable receptacle and cover members adapted to be fastened through a machine support surface for the reception of a lock barrel and plate assembly engageable through a bottom cover of the machine and by which a cable lanyard is engaged through members of the machine frame that is secured thereby. A feature is the inaccessibility of the mounting fasteners, and the utter awkwardness of the lanyard and machine relationship which discourages the use of tools, and the cable construction which cannot be cut with ordinary or even heavy duty manually operable cutters.

The foregoing and other various objects and features of this invention will be apparent and fully understood from the following detailed description of the typical preferred forms and applications thereof, throughout which description reference is made to the accompanying drawing.

PREFERRED EMBODIMENT

Figure 1:
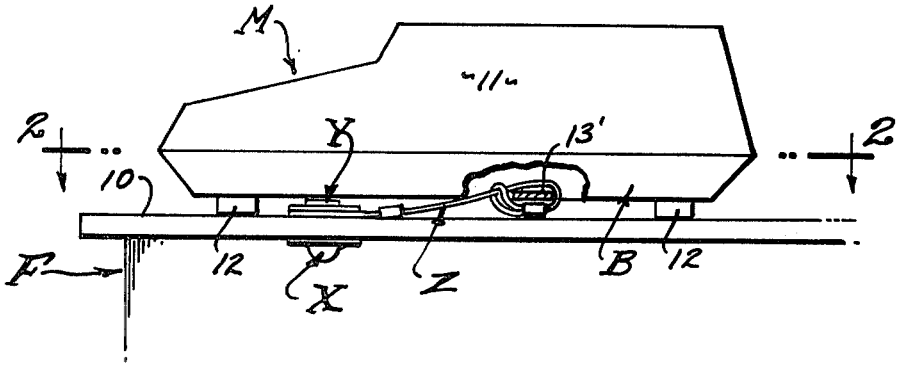
FIG. 1 is a side elevation of a typical business machine configuration supported upon a work surface and base of the frame secured thereto by means of the security device of the present invention.
Figure 2:
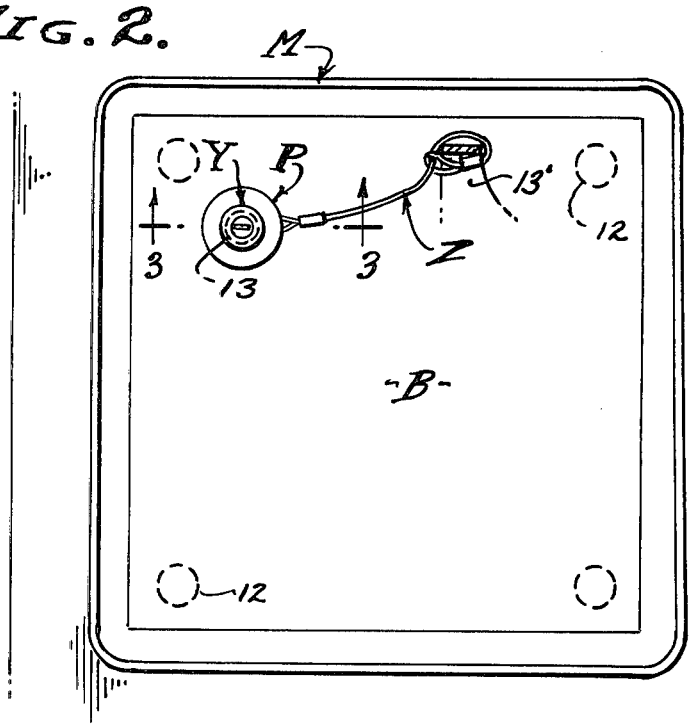
FIG. 2 is a plan view similar to the securement of FIG. 1, showing the bottom cover of the machine and its coupled attachment by means of this security device and the frame of the machine separately attached by the lanyard.

Referring now to the drawings, there is a machine M to be protectively secured to a piece of heavy furniture F such as to a desk top 10 on which the machine frame 11 or bottom cover is supported upon its legs or pads 12. The top 10 is horizontally disposed and the machine M remains in position by means of frictional engagement of the pads 11 with the top 10 through the force of gravity. Normally, such a machine can be manually lifted from its supported position, and some such machines are separable from their bottom cover or base B. However, from the drawings it will be observed that we have provided hardware that attaches both the base B and the machine M to the furniture F, and which involves a securement device comprised of separable receptacle and cover assembly X adapted to be fastened through the bottom cover or base B and through the top 10 of the desk as by means of screw fasteners S for the reception of a lock unit Y assembled with a plate P, and/or around which a lanyard Z is also looped through the frame 11. Characteristically, the bottom cover or base B is fabricated with openings 13 through which the lock unit Y is engaged, and the frame 11 is fabricated with numbers 13' around which the lanyard Z is trained as shown and later described.

Referring now to the assembly X, there is a receptacle R and a cover C joined together by the screw fasteners S to embrace the upper and lower surfaces of the top 10. The receptacle R is comprised of a planar member 15, preferably of disc form with a central opening 16 and a concentric hole pattern 17 intermediate said opening and its periphery 18, also with a depending cylinder 19 concentric with said opening and terminating in latch shoulder 20. The cover C is likewise comprised of a planar member 25, preferably of disc form with an imperforate center portion 26 and a concentric hole pattern 27 intermediate said portion and its periphery 28, also with a depending housing portion 29. The members 15 and 25 are of like configurations and the hole patterns 17 and 27 are complementary, for example three holes in each; holes 17 in member 15 being countersunk for flat headed screw fasteners S, and holes 27 in member 25 being tapped for threaded engagement with said screw fasteners S. The housing portion 29 of member 25 accommodates the lower extending portion of the lock unit Y.

Figure 5:
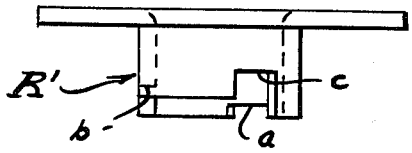
FIG. 5 is a view of a modified receptacle member removed from the assembly of FIG. 3 and showing the stepped configuration thereof.

FIG. 5 of the drawings illustrates a modified receptacle member R' wherein stepped latch shoulders a, b and c are provided so as to accommodate tops 10 of incrementally varied thichness. A feature is that each stepped shoulder is notched, as shown, to be recessed and prevent the bolt of the lock unit Y from being displaced therefrom. Accordingly, the securement device is selectively adjustable to tops 10 of different thicknesses as may be required.

Installation of the assembly X is accomplished by drilling and/or boring an opening 30 in the desk top 10, an opening to freely pass the cylinder 19, and a hole pattern 37 complementary to the aforementioned hole patterns 17 and 27, to freely pass the shanks of fasteners S. The thickness of top 10 can vary, a relatively thin top being shown in which case the housing portion 29 of member 25 receives the lower extremity of lock unit Y. However, thicker tops will preclude said entry of unit Y into the housing portion 29. A feature is the selection and use of screw fasteners S that thread into the tapped holes 27 without protruding from the cover C, whereby they cannot be conveniently engaged by tools. Another feature is the use of screw fasteners S having hardened ends indicated at 31 and which cannot be penetrated with ordinary drills. Accordingly, the installation of assembly X as it is shown in FIG. 3 of the drawings is characterized by the flat planar members 15 and 25 with flush screw fasteners S top and bottom, there being a center receptacle opening 16 for receiving the latch cylinder 19 with the base B and/or cover plate P overlying the hole pattern and heads of the fastener S.

Referring now to the lock unit Y and plate P assembly, said lock unit Y is comprised of a cylindrical barrel 36 slidably engageable through opening 16 and into the latch cylinder 19. The upper end of barrel 36 features a radial stop flange 35 presenting a downwardly faced shoulder to capture the plate P which slides freely over said barrel. The plate P coextensively overlies the hole pattern 17 and has a periphery 38 complementary to the periphery 18 of member 15, thereby covering the said hole pattern 17. Spaced from said stop flange there is a rectractile bolt 34 with an upwardly faced shoulder to oppose said flange shoulder, the bolt 34 being positioned to engage beneath the latch shoulder 20 of member 15. The lock unit Y is operated by means of a key 33 to retract the bolt 34 for release from beneath said shoulder 20, the barrel 36 having a conventional tumbler means (not shown) responsive to manual turning of the key 33.

Figure 3:
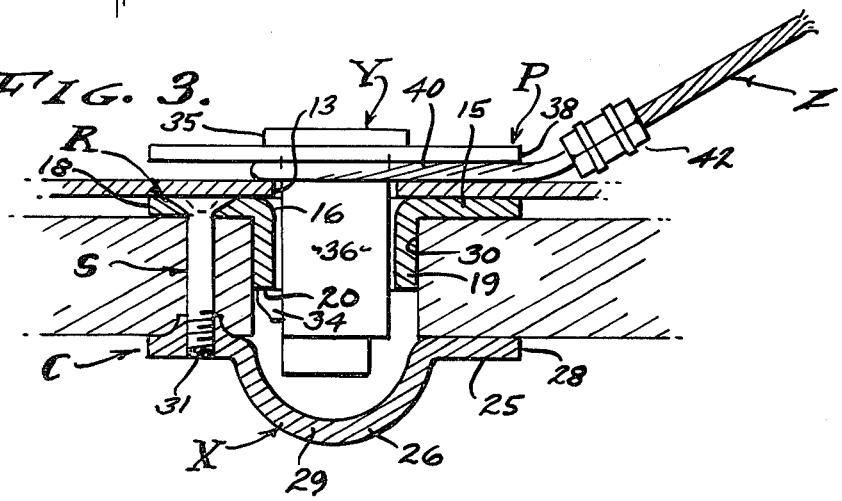
FIG. 3 is an enlarged detailed sectional view of the security device and taken as indicated by line 3—3 on FIG. 2.
Figure 4:
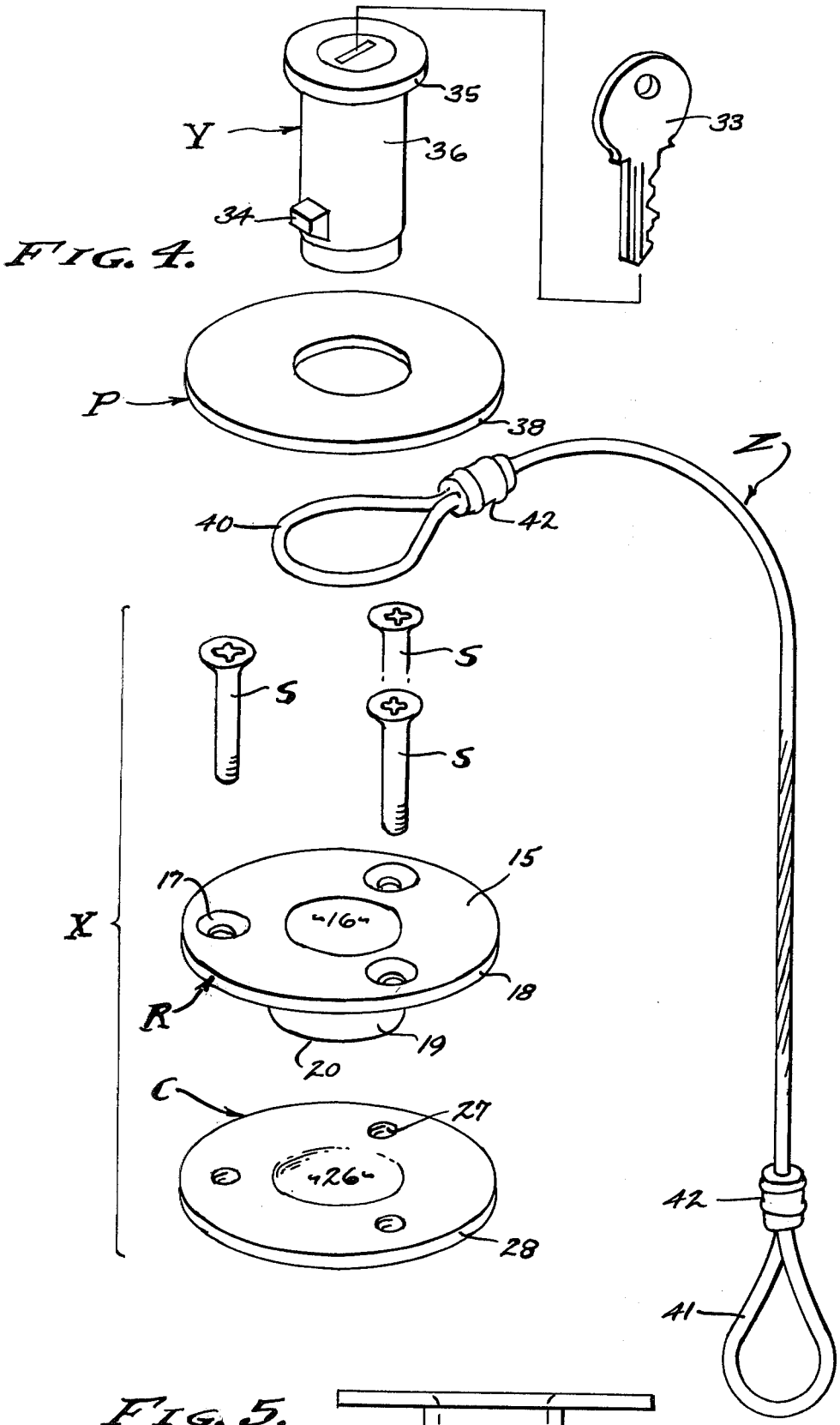
FIG. 4 is an exploded perspective view showing the related components of the security device.

FIG. 3 of the drawings illustrates the coupled attachment of the bottom cover or base B to the top 10, by means of the cooperative engagement of the lock unit Y and plate P assembly engaged through the aforementioned opening 13 therein. In practice, the cover B is of shell configuration, having a relatively thin wall through which the barrel 36 passes with the plate P opposed thereto. In the preferred installation, the plate P is in spaced relation to the cover so as to receive the lanyard Z next to be described for the securement of the frame 11 in addition to the securement of the base B. It will be seen that the flange 35 and/or plate P secures the bottom cover or base B to the top 10.

Referring now to the lanyard Z, coupled attachment of the machine M to the furniture F is by cooperative engagement of the lanyard around the barrel 36 and simultaneously around the frame member 13'. In practice, a $\frac{1}{8}$ inch $7\times19$ stainless steel cable Mil spec. 302 & 304 as manufactured by Whitco of New Jersey, is employed with opposite looped ends 40 and 41 formed with like swaged fittings 42. As shown, one loop 40 is trained around the frame member 13' and the loop 41 passed therethrough and then engaged over and around the barrel 36 prior to its entry in the receptacle opening 16 and into the latch cylinder 19. In carrying out this invention the barrel 36 length and bolt 34 position is coordinated with the flange 35 shoulder, to closely accommodate the thickness of plate P and the diameter of the cable of lanyard Y, the loop 41 being of sufficient size to be formed over the barrel 36 and projecting bolt 34. In practice, a normal cable length of 12–14 inches is most practical.

From the foregoing it will be apparent that a very simple device and installation thereof is provided for the securement of a machine to a work top or piece of furniture. In practice, the nominal height of exposed lock unit Y above the top 10 is $\frac{1}{2}$ inch, or less; to lie beneath a frame 11 held raised thereabove by the legs 12. The barrel 36 is engageable through an opening 13 in the bottom cover as base B for its recurrent, and a non interfering frame member 13' is selected for coupling the lanyard Y, either to the frame 11 or to the base B thereof, as circumstances require.

Having described only a typical preferred forms and applications of our invention, we do not wish to be limited or restricted to the specific details herein set forth, but wish to reserve to ourselves any modifications or variations that may appear to those skilled in the art as set forth within the limits of the following claims.

We claim:

1. A security device for attachment of a machine frame to a supporting furniture top and including;

an assembly comprised of a planar receptacle member with a central opening therethrough and a concentric hole pattern intermediate said opening and a periphery thereof, a planar cover member with an imperforate center portion and a concentric hole pattern intermediate said portion and a periphery thereof, and said hole patterns of the two members being complementary for the reception of fasteners engaged through the furniture top from the receptacle member and into the cover member, a lock unit and plate assembly comprised of a lock barrel engageable through the central opening in the receptacle member and a plate positioned thereby in coextensive spaced opposition to the receptacle member and overlying the fasteners engaged therethrough, said lock barrel having key operated means to releasably engage the receptacle member, the lock unit barrel being engaged through means connected to the machine frame.

2. The security device as set forth in claim 1, wherein the means connected to the machine frame is a bottom cover forming the base of the machine.

3. The security device as set forth in claim 1, wherein the means connected to the machine frame is a lanyard means trained around a frame member and simultaneously around the lock barrel within the protective confines between the receptacle member and opposed plate.

4. The security device as set forth in claim 1, wherein the means connected to the machine frame is a bottom cover forming the base of the machine and with a lanyard means trained around a frame member and simultaneously around the lock barrel within the protective confines between the receptacle member and opposed plate.

5. The security device as set forth in any one of claims 1 through 4, wherein the key operated means includes a retractile bolt projecting radially from the lock barrel and disengageable from the receptacle member at the central opening therethrough.

6. The security device as set forth in any one of claims 1 through 4, wherein the receptacle member has a depending cylinder concentric with the central opening and having a latch shoulder, and wherein the lock barrel enters the cylinder and the key operated means includes a retractile bolt projecting radially from the lock barrel and disengagable from the latch shoulder.

7. The security device as set forth in any one of claims 1 through 4, wherein the lock barrel is elongated and extends through the central opening in the receptacle member, and wherein the cover member has a depending central housing portion to accommodate the lower extremity of the lock barrel.

8. The security device as set forth in any one of claims 1 through 4, wherein the lock unit and plate are separable, the lock barrel having a radial flange with a shoulder opposed to and positioning the plate in said opposition to the receptacle member, and said plate having a central opening to engage freely over said lock barrel.

9. The security device as set forth in any one of claims 1 through 4, wherein the fasteners are screw fasteners having shanks extending through the receptacle member and threaded into the cover member.

10. The security device as set forth in any one of claims 1 through 4, wherein the fasteners are screw fasteners having shanks extending through the receptacle member and threaded into the cover member and terminating substantially flush therewith.

11. The security device as set forth in any one of claims 1 through 4, wherein the fasteners are screw fasteners having shanks extending through the receptacle member and threaded into the cover member and with hardened ends terminating substantially flush therewith.

12. The security device as set forth in any one of claims 1 through 4, wherein the fasteners are screw fasteners having flat heads countersunk flush with the receptacle member and with shanks extending through the receptacle member and threaded into the cover member.

13. The security device as set forth in any one of claims 1 through 4, wherein the fasteners are screw fasteners having flat heads countersunk flush with the receptacle member and with shanks extending through the receptacle member and threaded into the cover member and terminating substantially flush therewith.

14. The security device as set forth in any one of claims 1 through 4, wherein the fasteners are screw fasteners having flat heads countersunk flush with the receptacle member and with shanks extending through the receptacle member and threaded into the cover member and with hardened ends terminating substantially flush therewith.

15. The security device as set forth in any one of claims 1 through 4, wherein the lanyard means is comprised of a flexible multi strand cable of tough cut resistant material.

16. The security device as set forth in any one of claims 1 through 4, wherein the lanyard means is comprised of a flexible cable with opposite looped ends, one looped end being passed through an opening in the machine frame and the other looped end passed through the first mentioned looped end and then engaged over the lock barrel within said protective confines.

17. The security device as set forth in any one of claims 1 through 4, wherein the lanyard means is comprised of a flexible multi strand cable of tough cut resistant material with opposite looped ends, one looped end being passed through an opening in the machine frame and the other looped end passed through the first mentioned looped end and then engaged over the lock barrel within said protective confines.

18. The security device as set forth in any one of claims 1 through 4, wherein the furniture top is an element of the combination and includes an opening therethrough to receive the lock barrel and a complementary hole pattern to pass the said fasteners.

* * * * *